US007708576B2

(12) United States Patent
Hughes et al.

(10) Patent No.: US 7,708,576 B2
(45) Date of Patent: May 4, 2010

(54) ELECTRICAL CONNECTOR INCLUDING A RING AND A GROUND SHIELD

(75) Inventors: David Charles Hughes, Rubicon, WI (US); Marie Way, Burlington, WI (US); Mark Kadow, Pewaukee, WI (US)

(73) Assignee: Cooper Industries, Ltd., Houston, TX (US)

( * ) Notice: Subject to any disclaimer, the term of this patent is extended or adjusted under 35 U.S.C. 154(b) by 0 days.

(21) Appl. No.: 12/197,930

(22) Filed: Aug. 25, 2008

(65) Prior Publication Data

US 2010/0048046 A1 Feb. 25, 2010

(51) Int. Cl.
*H01R 13/53* (2006.01)

(52) U.S. Cl. ..... 439/181; 439/183; 439/184; 439/185; 439/186; 439/187; 439/921

(58) Field of Classification Search ..... 439/98, 439/181, 183–187, 190, 206, 921
See application file for complete search history.

(56) References Cited

U.S. PATENT DOCUMENTS

| | | | |
|---|---|---|---|
| 1,752,865 | A | 4/1930 | Thorpe |
| 1,783,062 | A | 11/1930 | Trencham |
| 1,997,081 | A | 4/1935 | Reynolds |
| 2,605,389 | A | 7/1952 | Kimball |
| 2,667,532 | A | 1/1954 | Ewer |
| 2,688,498 | A | 9/1954 | Wilson |
| 2,892,991 | A | 6/1959 | Beebee et al. |
| 2,914,344 | A | 11/1959 | Anthes |
| 3,392,363 | A | 7/1968 | Geis, Jr. et al. |
| 3,474,386 | A | 10/1969 | Link |
| 3,509,518 | A | 4/1970 | Phillips |
| 3,513,425 | A | 5/1970 | Arndt |
| 3,652,975 | A | 3/1972 | Keto |
| 3,663,928 | A | 5/1972 | Keto et al. |

(Continued)

FOREIGN PATENT DOCUMENTS

| | | | |
|---|---|---|---|
| GB | 2254493 | A | 10/1992 |

(Continued)

OTHER PUBLICATIONS

Loadbreak Apparatus Connectors, "200 A 25 kV Class Loadbreak Bushing Insert," Service Information 500-26, Cooper Power Systems, May 2003, pp. 1-2.

(Continued)

*Primary Examiner*—Edwin A. Leon
*Assistant Examiner*—Vanessa Girardi

(57) ABSTRACT

A high-voltage electrical connector system comprises a bushing with a longitudinal axis, a shoulder, a first end, and a second end, wherein the shoulder is between the first end and the second end; a ring arranged circumferentially around a first outside diameter of the bushing, the ring disposed between the shoulder and the second end, the ring including a channel therein defining a circumferential extension extending axially toward the first end; a ground shield disposed on a second outside diameter of the bushing between the ring and the second end, the ground shield comprising one or more of conductive material and semiconductive material; and an insulative portion adjacent the ring and disposed circumferentially over a portion of the ground shield.

21 Claims, 7 Drawing Sheets

U.S. PATENT DOCUMENTS 3,670,287 A 6/1972 Keto
3,678,432 A 7/1972 Boliver
3,720,904 A 3/1973 De Sio
3,727,951 A 4/1973 Shire
3,826,860 A 7/1974 De Sio et al.
3,835,439 A 9/1974 Yonkers
3,860,322 A 1/1975 Sankey et al.
3,915,534 A 10/1975 Yonkers
3,953,099 A 4/1976 Wilson
3,955,874 A 5/1976 Boliver
3,957,332 A 5/1976 Lambert, III
3,960,433 A 6/1976 Boliver
4,067,636 A 1/1978 Boliver et al.
4,113,339 A 9/1978 Eley
4,123,131 A 10/1978 Pearce, Jr. et al.
4,186,985 A * 2/1980 Stepniak et al. ..... 439/185
4,210,381 A 7/1980 Borgstrom
4,223,179 A 9/1980 Lusk et al.
4,260,214 A 4/1981 Dorn
4,722,694 A 2/1988 Makal et al.
4,793,637 A 12/1988 Laipply et al.
4,822,291 A 4/1989 Cunningham
4,863,392 A 9/1989 Borgstrom et al.
4,867,687 A 9/1989 Williams et al.
4,911,655 A 3/1990 Pinyan
4,972,049 A 11/1990 Muench
5,002,315 A 3/1991 Bartholomew
5,114,357 A 5/1992 Luzzi
5,130,495 A 7/1992 Thompson
5,213,517 A 5/1993 Kerek et al.
5,221,220 A 6/1993 Roscizewski
5,230,640 A 7/1993 Tardif et al.
5,248,263 A 9/1993 Sakurai et al.
5,266,041 A 11/1993 De Luca
5,277,605 A 1/1994 Roscizewski et al.
5,356,304 A 10/1994 Colleran
5,358,420 A 10/1994 Cairns et al.
5,393,240 A 2/1995 Makal et al.
5,433,622 A 7/1995 Galambos
5,445,533 A 8/1995 Roscizewski et al.
5,492,487 A 2/1996 Cairns et al.
5,525,069 A 6/1996 Roscizewski et al.
5,641,306 A 6/1997 Stepniak
5,641,310 A 6/1997 Tiberio, Jr.
5,655,921 A 8/1997 Makal et al.
5,766,030 A 6/1998 Suzuki
5,795,180 A 8/1998 Siebens
5,816,835 A 10/1998 Meszaros
5,846,093 A 12/1998 Muench et al.
5,857,862 A 1/1999 Muench et al.
5,957,712 A 9/1999 Stepniak
6,168,447 B1 1/2001 Stepniak et al.
6,213,799 B1 4/2001 Jazowski et al.
6,416,338 B1 7/2002 Berlovan
6,504,103 B1 1/2003 Meyer et al.
6,517,366 B2 2/2003 Bertini et al.
6,585,531 B1 7/2003 Stepniak et al.
6,790,063 B2 9/2004 Jazowski et al.
6,796,820 B2 9/2004 Jazowski et al.
6,811,418 B2 11/2004 Jazowski et al.
6,843,685 B1 1/2005 Borgstrom et al.
6,905,356 B2 6/2005 Jazowski et al.
6,939,151 B2 9/2005 Borgstrom et al.
6,984,791 B1 1/2006 Meyer et al.
7,044,760 B2 5/2006 Borgstrom et al.
7,077,672 B2 * 7/2006 Krause et al. ..... 439/181
7,083,450 B1 * 8/2006 Hughes ..... 439/181
2002/0055290 A1 5/2002 Jazowski et al.
2002/0164896 A1 * 11/2002 Borgstrom et al. ..... 439/183
2003/0228779 A1 12/2003 Jazowski et al.
2005/0208808 A1 9/2005 Jazowski et al.
2005/0260876 A1 11/2005 Krause et al.
2008/0045058 A1 * 2/2008 Stepniak et al. ..... 439/187

FOREIGN PATENT DOCUMENTS

JP 62-198677 12/1987
JP (U)-S63-93081 6/1988
JP 1-175181 7/1989
JP H-3-88279 9/1991
JP H-4-54164 5/1992

OTHER PUBLICATIONS

Loadbreak Apparatus Connectors, "200 A 25 kV Class Cooper Posi-Break™ Expanded Range Loadbreak Elbow Connector," Service Information 500-29, Cooper Power Systems, Jan. 2004, pp. 1-4.
Product Brief, "Latched Elbow Indicator," Cooper Power Systems, Bulletin 94014, Apr. 1994, 1 page.
Fox, Kevin, "The Cooper Posi-Break™ Solution to Separable Connector Switching Problems at Wisconsin Electric Power Company," Component Products, Bulletin No. 98065, Copyright 1998 Cooper Power Systems, MI Oct. 1998 5M, 2 pages.
Loadbreak Apparatus Connectors, "220 A 25 kV Class Loadbreak Junction," Service Information 500-32, Cooper Power Systems, Jul. 2005, pp. 1-4.
"The Cooper Posi-Break™ Elbow and Cap, Engineered Solution Increases Strike Distance and Improves Reliability," Copyright 1998 Cooper Power Systems, Inc., Bulletin 90814, MI 398/15M, 6 pages.
Steve Larson, "3.5kV Elbow Backoff & Loadbreak Problems", Pacific Power Internal Correspondence, Aug. 24, 1987, 17 pages.
Roger Provencal, "35kV LB Switching Working Conference" Elastimold Division, Amerace Corporation, Aug. 8, 1998, 1 pages.
Thomas Champion, "An Overview of Failure Analysis", Sep. 17, 1996, pp. 1-17.
Frank Stepniak, "Effects of Partial Vacuum on 35kV Seperable Connector Switching Performance", Sep. 16, 1996, 8 pages.
Steve Larson, "Elastimold 35kV Elbow/Bushing Interface Failures", Pacific Power Internal Correspondence, Jan. 29, 1988, 2 pages.
"Elastimold, New Dimension in Loadbreak" Elastimold Div. Amerace Corp. 1974, Section No. 410-50, 8 pages.
"Get Smart, A Current Issues Newsletter for the Utility Products Salesforce", Egal Industries, Inc.—Utility Group, Jun. 1994, 4 pages.
John Makal, "ICC Task Force 10-50, Meeting Minutes Nov. 5, 1991", Apr. 22, 1992, 1 page.
"Joy Break Safe Bushing Plug 15kV, 200 amp, Operation and Warranty," Joy Manufacturing Company, Dec. 1971, 3 pages.
"Loadbreak Apparatus Connectors," Cooper Power Systems, 200 A 25kV Class Loadbreak Bushing Insert, Jan. 1997, 7 pgs.
"200 A 25 kV Class Cooper POSI-BREAK Loadbreak Elbow Connector," Cooper Power Systems, Jan. 1998, 6 pages.
J.M. Makal, "Low Current Switching Phenomena," Sep. 1996, Cooper Power Systems, 23 paggs.
"Minutes of the 100th Meeting," IEEE Power Engineering Society—Insulated conductors Committee, IEEE, Nov. 3-6, 1996, 43 pgs.
"Minutes of the 101st Meeting," IEEE Power Engineering Society—Insulated conductors Committee, IEEE, Apr. 20-23, 1997, 5 pgs.
"Minutes of the 102nd Meeting," IEEE Power Engineering Society—Insulated conductors Committee, IEEE, Nov. 2-5, 1997, 52 pgs.
"Minutes of the 84th Meeting," IEEE Power Engineering Society—Insulated conductors Committee, IEEE, Apr. 26-23, 1989, 7 pages.
"Minutes of the 86th Meeting," IEEE Power Engineering Society—Insulated conductors Committee, IEEE, Apr. 29-May 2, 1990, 6 pages.
"Minutes of the 90th Meeting," IEEE Power Engineering Society—Insulated conductors Committee, IEEE, Apr. 26-29, 1992.
"RTE Transformer Components—8.3 V o—GND Air SBT Bushing" RTE Corporation, Section 1110, Jan. 3, 1978, 3 pgs.
"Minutes of the 92nd Meeting," IEEE Power Engineering Society—Insulated conductors Committee, IEEE, Nov. 8-11, 1992, 4 pages.

"Minutes of the 95th Meeting," IEEE Power Engineering Society—Insulated conductors Committee, IEEE, May 22-25, 1994, 6 pages.
"Minutes of the 97th Meeting," IEEE Power Engineering Society—Insulated conductors Committee, IEEE, Apr. 9-12, 1995, 3 pages.
"Minutes of the 99th Meeting," IEEE Power Engineering Society—Insulated conductors Committee, IEEE, Apr. 14-17, 1996, 5 pages.
"Notice—Elastimold Product Bulletin," PB: 400-10-91, Oct. 21, 1991, 1 page.
Gail Shaw, "Operation of 35kV Underground Systems," Pacific Power & Light Company, Jun. 27, 1984, 10 pages.
R.J. Stanger, "Qualitative Evaluation of 15kV Loadbreak Designs,"Elastimold Division, Amerace Corporation, Aug. 16, 1973, 8 pages.
Frank Stepniak, "Resolution of the Flashover Problem," Elastimold Correspondence, Feb. 27, 1998, F. Stepniak, 18 pages.
"8.3kVo—GND Air SBT Bushing", RTE Corporation, Section 1110, Jan. 3, 1978, p. 1.
"Safe-T-Ring Collar—An Anti-Vacuum Device," 9U02RING, Advertisement; Jan. 2000, Hubbell Power Systems Inc., 3 pgs.
"Seperable Insulated Connector Systems for Power Distribution Systems Above 600V" American National Standard [ANSI] IEEE Standard, Jun. 25, 1985,29 pages.
Plaintiff's Markman Claim Construction Brief, including Exhibits 1, 2, 3, 4, 5, and 9, filed in Civil Dicket No. 2:06-CV-242, Dec. 17, 2007, 125 pgs.
Plaintiff's Motion for Partial Summary Judgment that Certain Documents are Not Printed Publications Under 35 U.S.C. §102 filed in Civil Docket No. 2:06-CV-242, Jul. 9, 2008, 26 pg.
Amended Agreed Protective Order executed by Charles Everingham IV, U.S. Magistrate Judge in Civil Docket No. 2:06-CV-242, Nov. 20, 2007, 15 pgs.
Declaration of Frank Muench with Exhibit A, Submitted under 37 CFR 1.131, Mar. 12, 2007, 10 pages.
Declaration of Frank Muench with Exhibit A, Submitted under 37 CFR 1.131, Jun. 11, 2008, 70 pages.
Declaration of Elizabeth Ducote with Exhibits A-D (A, B, C are Redacted), Nov. 30, 2007, 38 pages.
Declaration of Henry Hecker with Exhibits A-D, Submitted by Patent Owner in U.S. Appl. No. 95/000,209 Reexam, Jul. 6, 2007, 44 pages.
Declaration of Craig Wahlgren with Exhibits A-M, Submitted by Patent Owner in U.S. Appl. No. 95/000,209 Reexam, Jul. 12, 2007, 45 pages.
Declaration of Andrew Meyer with Exhibit A, Submitted by Patent Owner in U.S. Appl. No. 95/000,209 Reexam, Jul. 12, 2007, 6 pages.
Declaration of Andrew Meyer with Exhibits A-B, Submitted under 37 CFR 1.131, Jul. 12, 2007, 35 pages.
Declaration of John Makal, Submitted by Patent Owner in U.S. Appl. No. 95/000,209 Reexam, Jul. 12, 2007, 47 pages.
Declaration of Larry Siebens with Exhibit A, Submitted by Third Party Requester in U.S. Appl. No. 95/000,209 Reexam, Aug. 13, 2007, 12 pages.
Declaration of Frank Stepniak with Exhibits A-D, 1st Declaration, Submitted by Third Party Requester in U.S. Appl. No. 95/000,209 Reexam, Dec. 18, 2006, 39 pages.
Declaration of Frank Stepniak with Exhibits A-G (E Redacted), 2nd Declaration, Submitted by Third Party Requester in U.S. Appl. No. 95/000,209 Reexam, Aug. 8, 2007, 86 pages.
Declaration of Frank Stepniak with Exhibits A-F (F Redacted), 3rd Declaration, Submitted by Third Party Requester in U.S. Appl. No. 95/000,209 Reexam, Dec. 21, 2007, 53 pgs.
Declaration of William A. Thue with Exhibit A, Submitted by Third Party Requester in U.S. Appl. No. 95/000,209 Reexam, Aug. 3, 2007, 15 pages.
Declaration of William A. Thue in Support of Defendant's Motion for Summary Judgment filed in Civil Docket No. 2:06-CV-242, Jul. 28, 2008, 128 pages.
Declaration of Kevin W. Jakel, Jul. 28, 2008, 66 pages.
Declaration of Steve Larson with Exhibit A-B, Submitted by Third Party Requester in U.S Appl. No. 95/000,209 Reexam, Aug. 9, 2007, 24 pages.
Declaration of Steve Larson with Exhibit A in Request for Reexamination of U.S. Patent No. 6,504,103B1, Nov. 30, 2006, 20 pgs.
Declaration of Roger Provencal with Exhibit A-B, Submitted by Third Party Requester in U.S. Appl. No. 95/000,209 Reexam, Aug. 9, 2007, 11 pages.
Request for Ex Partes Reexamination of U.S. Patent No. 6,504,103, Inventors: Meyer, et al; Dec. 21, 2006, pp. 1-55.
Request for Inter Partes Reexamination of U.S. Patent No. 6,984,791, Inventors: Meyer, et al; Dec. 21, 2006, 130 pages.
Non-Final Office Action dated Feb. 10, 2009 for U.S. Appl. No. 11/275,491, 12 pages.
Non-Final Office Action dated May 14, 2009 for U.S. Appl. No. 11/888,333, 16 pages.
Final Office Action dated Mar. 25, 2009 for U.S. Appl. No. 90/008,386 53 pages.
Second Supplemental Reply to Office Action filed Mar. 4, 2009 in U.S. Appl. No. 90/008,386, 4 pages.
Request for Reconsideration of Entry of Supplemental Replies filed Apr. 8, 2009 in U.S. Appl. No. 90/008,386 4 pages.
Petition to Enter Supplemental Reply filed Apr. 7, 2009 in U.S. Appl. No. 90/008,386 6 pages.
*Cooper Technologies Company* v. *Hubbell, Inc*., Complaint filed in Civil Docket No. 06-cv-0520, Apr. 26, 2006, 23 pgs.
"RTE Safe Break Terminator—Electrical Application and Operating Instruction," Manual 1067, RTE Corporation, 1967, 16 pages.
Defendant's Claim Construction Brief and Opposition to Plaintiff's Claim Construction Brief filed in Civil Docket No. 2:06-CV-242, Jan. 11, 2008, 37 pages.
Transcript of Trial, *Cooper Technologies Company* v. *Thomas & Betts Corporation*, Civil Docket No. 2:06-CV-242, Sep. 8, 2008, 9:00 a.m., pp. 1-92, inc. glossary, pp. 1-13.
Transcript of Trial, *Cooper Technologies Company* v. *Thomas & Betts Corporation*, Civil Docket No. 2:06-CV-242, Sep. 8, 2008, 1:30 p.m., pp. 1-166, inc. glossary, pp. 1-23.
Transcript of Trial, *Cooper Technologies Company* v. *Thomas & Betts Corporation*, Civil Docket No. 2:06-CV-242, Sep. 9, 2008, 8:30 a.m., pp. 1-160, inc. glossary, pp. 1-19.
Transcript of Trial, *Cooper Technologies Company* v. *Thomas & Betts Corporation*, Civil Docket No. 2:06-CV-242, Sep. 9, 2008, 1:15 p.m., pp. 1-200, inc. glossary, pp. 1-24.
Transcript of Trial, *Cooper Technologies Company* v. *Thomas & Betts Corporation*, Civil Docket No. 2:06-CV-242, Sep. 10, 2008, 8:30 a.m., pp. 1-156, inc. glossary, pp. 1-19.
Transcript of Trial, *Cooper Technologies Company* v. *Thomas & Betts Corporation*, Civil Docket No. 2:06-CV-242, Sep. 10, 2008, 1:15 p.m., pp. 1-180, inc. glossary, pp. 1-23.
Transcript of Trial, *Cooper Technologies Company* v. *Thomas & Betts Corporation*, Civil Docket No. 2:06-CV-242, Sep. 11, 2008, 8:30 a.m., pp. 1-173, inc. glossary, pp. 1-23.
Verdict Form, Cooper Technologies Compnay v. Thomas & Betts Corporation, Civil Docket No. 2:06-cv-242, 9 pages.
Memorandum Opinion and Order (claim construction) filed in Civil Docket No. 2:06-CV-242, Feb. 15, 2008, 14 pgs.
Plaintiff's Reply MARKMAN Claim Construction Brief and Opposition to Defendants' Claim Construction Brief filed in Civil Docket No. 2:06-CV-242, Jan. 22, 2008, 20 pgs.
Claim Construction Chart-Disputed and Agreed Terms Pursuant to P.R. 4-5 (d)(1) filed in Civil Docket No. 2:06-CV-242, Jan. 18, 2008, 19 pgs.
Deposition of Frank Muench, Mar. 26, 2008, pp. 1-292; Index pp. 1-33.
"Minutes/Meeting Notice on Application Guide for Separable Connectors" IEEE Distribution Subcommittee, Feb. 1994, 12 pages.
Order Granting Motion to Dismiss in Civil Docket No. 2:06-CV-242, Jan. 23, 2009, 1 page.
Joint Motion to Dismiss with Prejudice filed in Civil Docket No. 2:06-CV-242, Jan. 22, 2009, 4 pgs.
Defendant's Sur-Reply; Supporting Opposition to Cooper' Motion for Partial Summary Judgement; Certain Documents under USC 102 in Civil Dkt No. 2:06-CV-242, Aug. 20, 2008, 15 pgs.
Affidavit (James Beebe Declaration) in Support of Motion for Partial Summary Judgement; including Exhibits 1-3 in Civil Docket No. 2:06-CV-242, Jul. 9, 2008, 19 pages.

Plaintiff's Reply to Defendant's Opposition to Plaintiff's Motion for Partial Summary Judgment filed in Civil Docket No. 2:06-CV-242, Aug. 8, 2008, 18 pgs.
Defendant's Reply in Support of Its Motion for Partial Summary Judgment filed in Civil Docket No. 2:06-CV-242, Aug. 8, 2008, 40 pgs.
Defendant's Opposition to Plaintiff's Motion for Partial Summary Judgment filed in Civil Docket No. 2:06-CV-242, Jul. 28, 2008, 190 pgs.
Order Denying Defendant's Motion for Summary Judgment, Jul. 28, 2008, 1 pg.
Exhibits B—H in Support of Defendant's Motion for Summary Judgment of Invalidity Due to Anticipation and Obviousness filed in Civil Dkt No. 2:06-CV-242, Jul. 9, 2008, 65 pages.
Defendant's Motion for Summary Judgment of Invalidity Due to Anticipation and obviousness filed in Civil Docket No. 2:06-CV-242, Jul. 9, 2008, 50 pages.
Affidavit of Henry Hecker in Support of Motion for Partial Summary Judgment filed in Civil Docket No. 2:06-CV-242, Jul. 7, 2008, 4 pgs.

* cited by examiner

ELECTRICAL CONNECTOR INCLUDING A RING AND A GROUND SHIELD

TECHNICAL FIELD

The present description relates, in general, to electrical connectors and, more specifically, to electrical connectors with improved insulating features that can help to inhibit flashover.

BACKGROUND OF THE INVENTION

In underground electrical distribution systems that are energized to, e.g., 15 kV to 35 kV, it is common to employ high-voltage connector assemblies of the elbow/bushing variety. The IEEE STD 386 standard covers such electrical connectors. In their earliest and most basic form, bushing inserts had a squared-off shoulder with no venting and no latch indication, where the shoulder of the bushing is the area where the cuff of the elbow fits against the bushing. Oftentimes, bushing/elbow assemblies allow for connection and disconnection when the line is carrying current (i.e., load-make and loadbreak operations).

FIG. 6 is an illustration of terminator/bushing assembly 600, which is one prior art embodiment. Assembly 600 includes elbow terminator 610 and bushing insert 620. Elbow terminator 610 includes sleeve 612, cuff 611, and probe 613. When latched, sleeve 612 fits over bushing insert 620 such that the inner surface of cuff 611 fits snugly up against shoulder 621, and probe 613 is received into conductive tube 622. In FIG. 6, terminator 610 and bushing insert 610 are not drawn to the same scale.

At 25 kV there have been problems in the industry for many years concerning a phenomenon known as partial vacuum-induced flashover. Rarely, when an operator would pull an elbow off of a bushing, there would be an arc from the exposed conductive insert (of the elbow) to a conductive grounding shield on the bushing. It was discovered that flashover is caused by a decrease in the dielectric constant of the air trapped in the assembly due to a partial vacuum during loadbreak operations. In IEEE STD 386 elbow/bushing assemblies, the cuff of the elbow overlaps the collar of the bushing by about ½ inch, so that the first ½ inch of travel during a loadbreak operation creates a volume inside the elbow-bushing interface connection. The volume of air becomes greater without letting any other air enter the assembly, thereby lowering the pressure of the air. When air pressure is lowered, the dielectric strength of that air is also lowered, as described in Paschen's curve. The lowered dielectric strength of the air leads to lowered resistance and sometimes, arcing.

One prior solution to the flashover problem includes the use of additional insulation in the elbow terminator. Such a solution is described in U.S. Pat. No. 5,655,921, which is incorporated by reference herein. Furthermore, U.S. Pat. No. 5,655,921 also shows the use of an insulating layer placed over a grounding shield to prevent flashover.

Yet another approach includes decreasing or relieving the partial vacuum as it occurs. One such solution uses a vented bushing insert, which has slots and grooves on its shoulder to allow air to go underneath the cuff of the elbow and relieve the air pocket that is between the cuff of the elbow and the shoulder of the bushing. One problem with that design is that it only vents one of the cavities in which the vacuum is created, while leaving other small cavities unaddressed, e.g., the areas around the nose of the bushing.

Another problem with vented bushings is that the vents get plugged up with grease. When linemen put elbows and inserts together, they typically use silicone lubricants to slide the two rubber pieces together. It is an interference fit that is very tight, and the lubrication makes the elbows operable over the next twenty to thirty years. Over time, the lubrication thickens up, turns gluey, and will clog up the vents, making the elbow harder to operate, and pulling more vacuum. More vacuum leads to a greater chance of flashover. An example of a vented shoulder is shown in U.S. Pat. No. 6,939,151.

The difference in performance between the insulated elbow solution and the vented bushing solution led to changes in the IEEE standard for testing bushing elbow assemblies. The OIACWT, (Operating Interface AC Withstand Test) provides a way for testing new elbow/bushing designs. There are two tests in the standard—Option A and Option B. Option A is a partial vacuum test at 27.5 kV, with no lubricant, and Option B is a partial vacuum test with aged lubricant at 30.5 kV.

A beveled insert is the focus of another solution technique. A beveled insert refers to a bushing insert where the shoulder of the bushing is chamfered. Usually, the shoulder of a bushing is a ninety-degree corner per the IEEE STD 386 standard, but in a beveled insert, the corner is at a much shallower angle, e.g., forty-five degrees. The shallower angle keeps the cuff of the elbow from sealing to the shoulder of the bushing, thereby preventing partial vacuum from occurring. In order to further reduce cuff/shoulder sealing, some beveled inserts include flange-like protrusions that extend radially outward from the beveled surface.

Yet another solution includes using a J-ring adjacent to the shoulder of the bushing to relieve the partial vacuum at a short travel distance of the cuff. An example of a J-ring solution is shown in U.S. Pat. No. 7,083,450, which is incorporated by reference herein. J-ring solutions attempt to prevent cuff-shoulder sealing by changing the geometry of the outside surface of the bushing so that the cuff cannot create a seal during loadbreak. The J-ring design is similar to a counterbore design with an added protrusion, an example of which is labeled 115 in FIG. 3 of U.S. Pat. No. 7,083,450. The protrusion prevents the tip of the cuff from sealing along the bottom shelf of the counterbore. Once the tip of the cuff clears the point of the protrusion, it allows air to flow around the cuff of the bushing, thereby relieving any partial vacuum.

It is important to note that the J-ring design relieves vacuum differently from the other designs. Vented shoulders and beveled inserts hold the cuff outward to allow air to go underneath the cuff, whereas a J-ring design allows the cuff to fall. Typically, J-ring designs do not succumb to grease pack like vented shoulders do. Further, because so much material is taken away from the insert due to the counterbore, the starting volume of trapped air when the elbow is mated to the insert is much greater than that of the beveled insert and the vented insert. Thus, the pressure drop is not as severe, simply because the starting volume in the steady state latched position is so much greater than the general design. Thus, J-ring solutions provide better vacuum-relieving properties than other currently-available solutions.

BRIEF SUMMARY OF THE INVENTION

Various embodiments of the invention improve upon J-ring solutions by providing superior insulating properties in order to further reduce the incidents of flashover. For example, some embodiments place a layer of insulating material over a high-electrical-stress portion of a grounding shield adjacent to the J-ring. Areas of high electrical stress include a ridge or point formed by semiconductive material where the semiconductive material abuts the J-ring ring. Sharp ridges or point manipulate electric fields and can attract arcs. By placing a high-electrical-stress area under a layer of insulating material, the embodiment prevents arcing.

Other embodiments are directed to methods of making J-ring inserts with improved electrical properties. Some embodiments include manufacturing individual components of a bushing insert, such as a J-ring, a grounding shield, and a housing for the inner conductive parts of the bushing. The components are placed in an injection mold, where insulative rubber is injected to create a non-conductive portion in the space defined by the J-ring, the grounding shield, and the housing for the inner conductive parts. In some embodiments, the layer of insulative material that covers part of the grounding shield is manufactured as a separate component that is placed in the injection mold with the other components. In another example, the J-ring and the insulative layer are manufactured as a single component and placed into the mold with the other components. In yet another example, the grounding shield has holes there that allow the rubber fill to flow therethrough so that the layer of insulating material is formed from the rubber fill.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

Figure 1A:
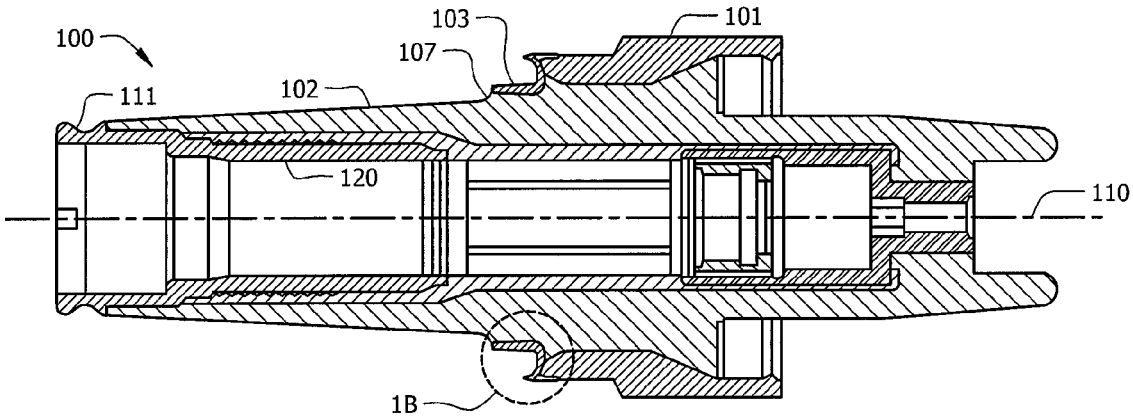
FIG. 1A is a cut-away illustration of an exemplary bushing insert adapted according to one embodiment of the invention.

FIG. 1A is a cut-away illustration of exemplary bushing insert 100 adapted according to one embodiment of the invention. In this example, busing insert 100 is configured to be mated to an elbow terminator (not shown), such as described and illustrated in U.S. Pat. No. 7,083,450, which is hereby incorporated herein by reference. For instance, when completely coupled to a terminator, groove 111 accommodates a latching ring within the terminator, a probe is received within bushing 100 along longitudinal axis 110, and the cuff of the terminator just covers ring 103. Bushing insert 100 includes, inter alia, shoulder 107, grounding shield 101, ring 103, and non-conducting portion 102.

Figure 1B:
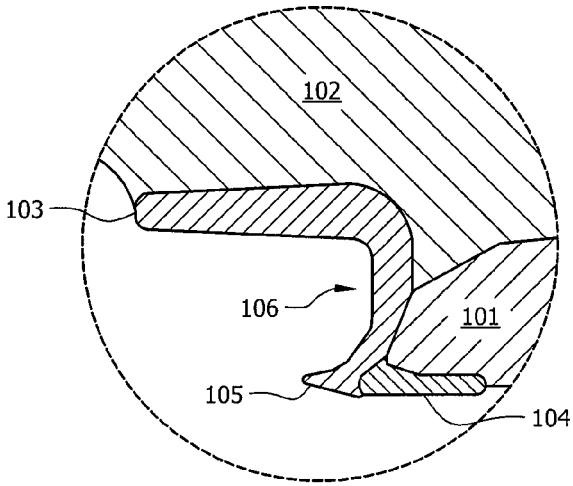
FIG. 1B shows a more detailed cut-away view of the interface of the various material surrounding the J-ring of FIG. 1A.

Grounding shield 101 operates to keep the outside surface of bushing 101 at ground potential, thereby providing a "dead front" for the safety of operators and others who may come into contact with the high-voltage electrical connector system. In many embodiments, grounding shield 101 is constructed of semiconductive ethylene propylene diene M-class (EPDM) rubber, and thus can conduct electrical charge. Attention is now drawn to FIG. 1B, which shows a view of a portion of bushing 100 of FIG. 1A. FIG. 1B shows a more detailed cut-away view of the interface of the various material surrounding J-ring 103. In this example, J-ring 103 includes axial protrusion 105 and trough 106. In FIG. 1B, there is a high-stress area where J-ring 103, grounding shield 101, and insulative portion 104 come together. Semiconductive material 101 comes to a point or ridge at this high-stress area. The present example embodiment overlays the high-stress point with insulative portion 104, thereby preventing arcing at voltages as high as 30.5 kV or higher.

The area where grounding shield 101 and insulative portion 104 come together at the outside surface of bushing insert 100 is a lower stress area. The axial extent of insulative portion 104 from J-ring 103 along the outside surface can be adjusted to eliminate the possibility of arcing. Specifically, the farther this lower-stress point is away from shoulder 107, the less the likelihood of an arc being able to form from the terminator probe (not shown) to grounding shield 101. For 25 kV and 30 kV applications of the IEEE STD 386 standard, a length of insulating portion 104 between ¼ inch and ⅝ inch is adequate to eliminate all or nearly all of the risk of flashover. In the various embodiments shown herein, the thickness of insulative portion 104 can be adapted for the specific use and may be influenced by factors such as operating voltage, material, and the like. For most IEEE STD 386 embodiments using molded thermoset plastic, a thickness of a tenth of an inch is adequate.

Prototypes tested showed unexpectedly positive results. For instance, Table 1 shows results of the OIACWT for crude, hand-made prototypes of the bushing insert shown in FIG. 1A, with nylon J-rings and semiconductive EPDM grounding shields. There are two groupings made with respect to cracks in the J-rings. One group "Cracks Included" includes prototypes tested that were confirmed to have very small cracks in their respective J-rings. "Cracks Culled" shows the same prototype set but without the data from bushings that included J-ring cracks. Table 1 shows that when an insert has a J-ring for vacuum relief but no other insulation, there was about a 20% pass rate for OIACWT option B. Furthermore, while not shown in the chart, merely including about ¼ inch of insulation over the end of a grounding shield of a bushing (without a J-ring) is expected to provide about a 0-5% passing rate for OIACWT option B. Since a J-ring alone provides about 20% success, and since insulation alone provides 0-5% success, one would expect a J-ring with added insulation (as shown in FIG. 1B) would provide between 20% and 25% success in OIACWT option B. However, Table 1 shows that a crude J-ring prototype with added insulation can be expected perform with about 90% success. Carefully manufactured bushing inserts can be expected to improve the approximately 90% success rate to at or near 100%. Thus, when paired together, a J-ring and grounding shield insulator exhibit synergy.

TABLE 1

| Design | Attempted | 30.5 kV Pass | % Pass | Attempted | 27.5 kV Pass | % Pass | Attempted | 24.5 kV Pass | % Pass |
|---|---|---|---|---|---|---|---|---|---|
| | | | | Cracks Included | | | | | |
| Recessed Groove no insulation | 5 | 1 | 20% | 11 | 2 | 18% | 0 | 0 | — |
| Recessed Groove 0.25" insulation | 2 | 0 | 0% | 17 | 12 | 71% | 8 | 8 | 100% |
| Recessed Groove 0.625" insulation | 13 | 12 | 92% | 12 | 10 | 83% | 3 | 3 | 100% |
| | | | | Cracks Culled | | | | | |
| Recessed Groove no insulation | 5 | 1 | 20% | 11 | 2 | 18% | 0 | 0 | — |
| Recessed Groove 0.25" insulation | 0 | 0 | — | 14 | 12 | 86% | 8 | 8 | 100% |
| Recessed Groove 0.625" insulation | 13 | 12 | 92% | 11 | 10 | 91% | 3 | 3 | 100% |

Manufacturing bushing insert 100, in some embodiments, starts by making the components that, together, form bushing insert 100. A shield housing (not shown) houses the current-carrying parts of bushing 100, such as aluminum contact tube 120 that mates with the probe of the terminator. The shield housing is molded out of rubber. J-ring 203 is also made usually by molding, as is grounding shield 101 and insulative portion 104. The components are placed in an injection mold, where non-conducting rubber is injected into the space defined between the shield housing and the other components (J-ring 103, grounding shield 101, and insulative portion 104. For the example embodiments herein, J-rings can be made of any of a variety of materials, including, e.g., plastic, fiberglass, nylon, thermoset plastic, thermal plastic rubber (TPR), thermal plastic elastomer (TPE) and the like.

Figure 2:
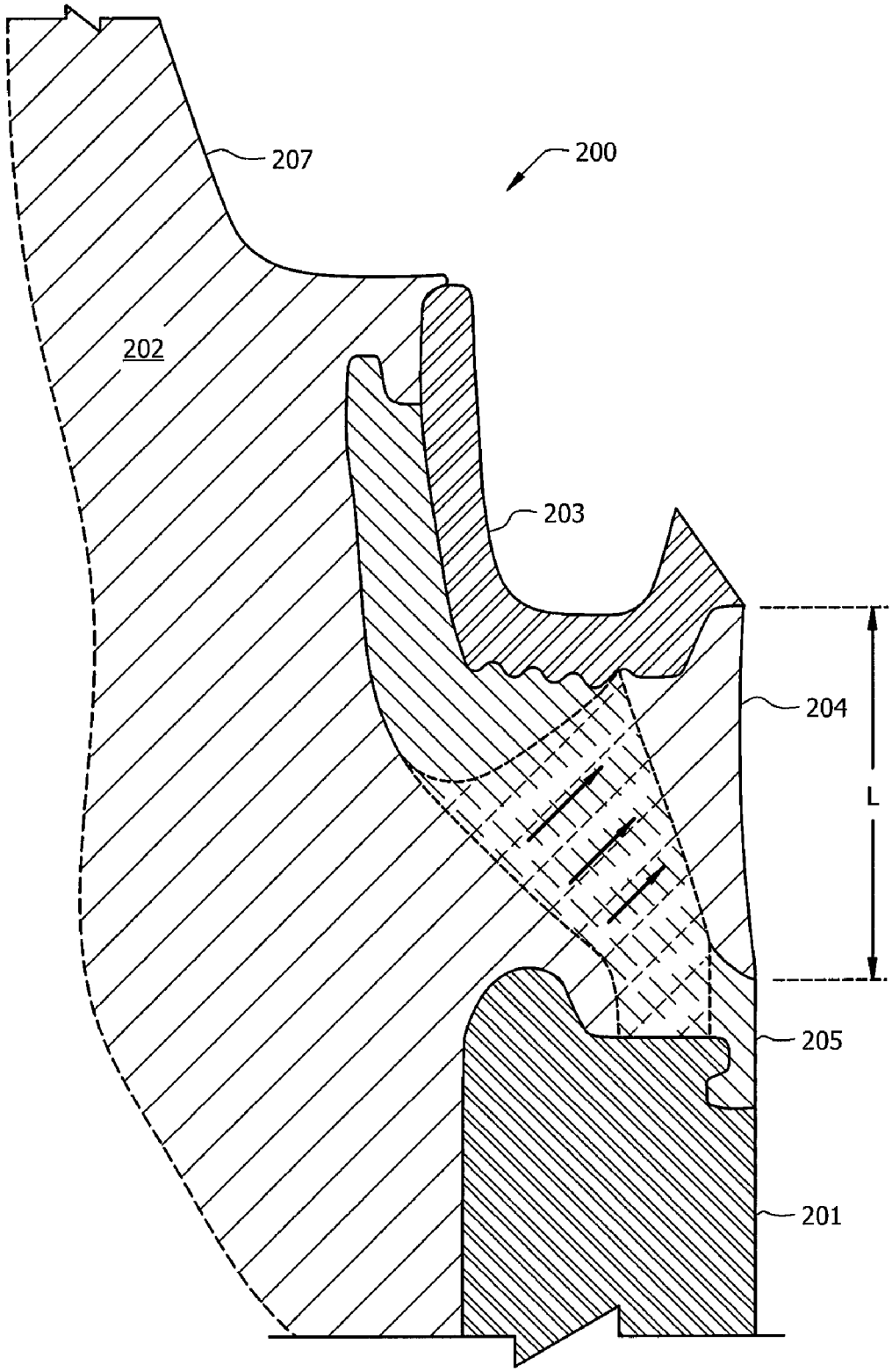
FIG. 2 is an illustration of an exemplary bushing adapted according to one embodiment of the invention.

FIG. 2 is an illustration of exemplary bushing 200 adapted according to one embodiment of the invention. Specifically, FIG. 2 is a detailed cut-away view showing the various materials and layers in proximity to J-Ring 203. In addition to J-ring 203, bushing insert 200 also includes insulative portion 204, first grounding shield portion 205, second grounding shield portion 201, and insulating rubber 202.

In bushing 200, the grounding shield is made of two parts (i.e., portions 201 and 205), which in this example are of different materials, though in other embodiments the grounding shield may be of the same or similar materials. The IEEE STD 386 standard requires that the conductive collar (of the grounding shield) be within a prescribed distance of shoulder (e.g., 207) of a bushing. The purpose of having the grounding shield close to the shoulder is to keep the dead front shell as long as possible for safety and to keep the electric field lines from escaping outside the bushing and making things hotter electrically. In the bushing of FIG. 1A, to fit J-ring in 103, conductive collar 101 is moved away from shoulder 107 to make room for J-ring 103. In other words, the design of FIG. 1A may not meet the shielding specification set forth in the IEEE STD 386 standard. Bushing insert 200 of FIG. 2 seeks to comply with the standard by disposing the conductive grounding shield so that it extends axially to a point very close to shoulder 207.

Also, the design of FIG. 2 shields the trough of J-ring 203 electrically from partial discharge. In FIG. 2, the ground plane formed by portions 201 and 205 goes under J-ring 203 and almost fully shields the entire length of J-ring 203. From the perspective of the trough, the nearest energized part is in the center of bushing 200 (not shown), which is separated from the trough by grounding shield portion 205. As a result, the electric field lines go from the energized parts of the insert (in the center of bushing 200 and not shown herein) toward the ground plane and stop there so that the electric filed lines do not penetrate into the air gap. Furthermore, as with the embodiment of FIG. 1, the ground plane is covered partially by insulative material (in this case, insulative portion 204) to inhibit flashover. The length of insulative portion 204 "L" can be adapted to a variety of applications, and can be around, e.g., ¼ inch to ⅝ inch for a bushing conforming to the IEEE STD 386 standard.

Similar to the embodiment of FIG. 1A, manufacturing bushing insert 200, in some embodiments, starts by making the components that form bushing insert 200. The shield housing is molded out of rubber. First grounding shield portion 205 is over-molded on J-ring 203 to create a bond between the materials. In this example, first grounding shield portion 205 is made of a black semiconductive plastic, such as carbon-loaded plastic or nylon, metal-loaded plastic, and/or the like. Also, second grounding shield portion 201 is made by molding, e.g., semiconductive EPDM. Second grounding shield portion 201 is then snapped to the component that includes J-ring 203 and first grounding shield portion 205 using, e.g., interlocking tabs where portions 201 and 205 contact. The snap-on operation makes a component that includes J-ring 203, as well as the entire semiconductive grounding shield.

After the snap-on operation, the snapped-together component and the shield housing are placed into a mold. The mold injects insulative rubber into the space defined by the shield housing and the snapped-together component. The insulative rubber forms non-conductive portion 202 and bonds to portions 201 and 205 as well as to J-ring 203. In some embodiments, insulative portion 204 is independently molded as a piece of black insulative plastic to slide into place over the outside diameter bushing 200. This can be done before or after non-conductive portion 202 is molded.

Alternatively, some embodiments provide for a plurality of holes in grounding shield portion 205, represented by arrows in FIG. 2. The holes allow the insulative rubber of portion 202 to flow therethrough during injection, thereby forming insulative portion 204 out of rubber during the molding process.

Figure 3:
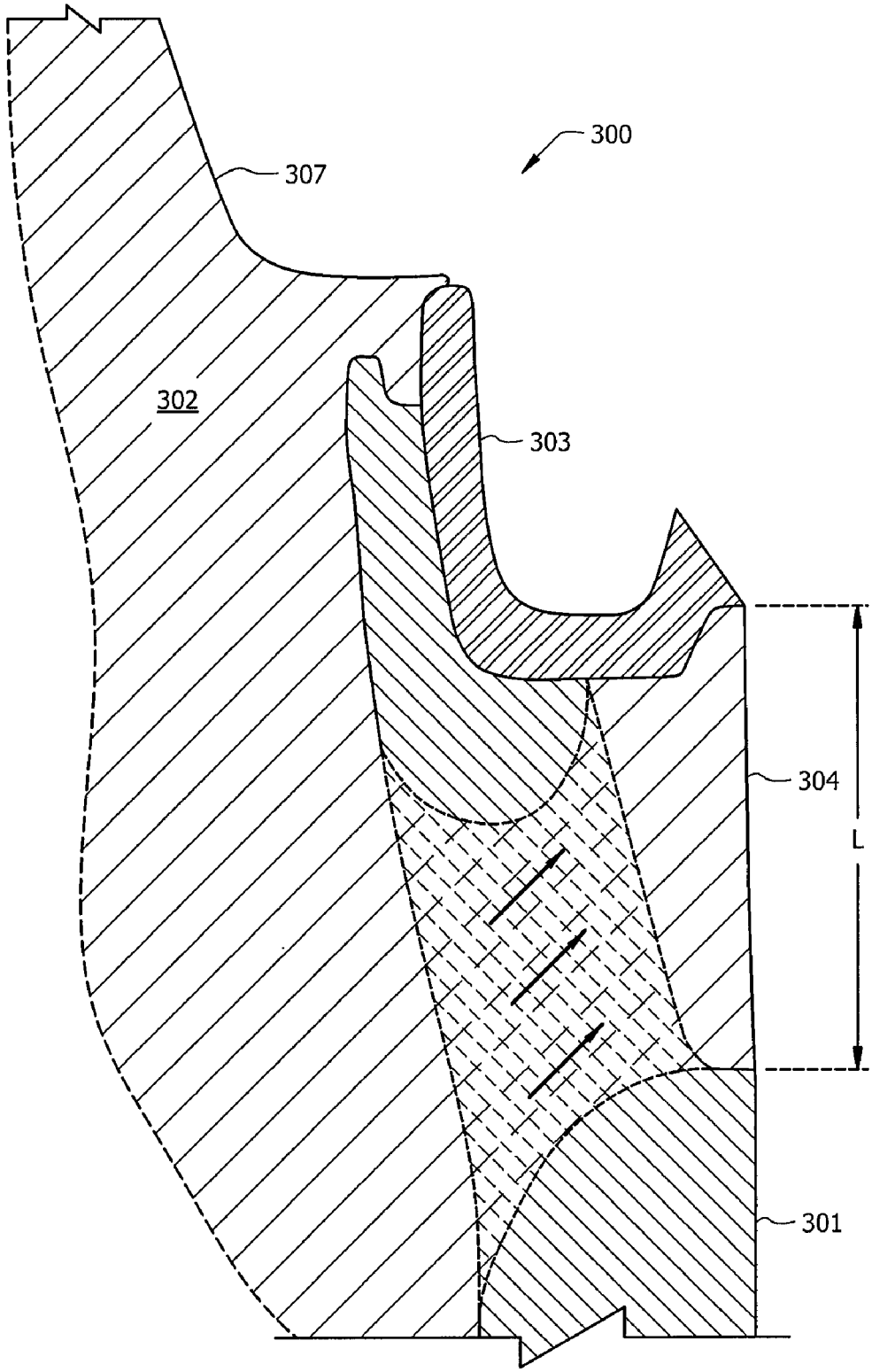
FIG. 3 is an illustration of an exemplary bushing insert adapted according to one embodiment of the invention.

FIG. 3 is an illustration of exemplary bushing insert 300 adapted according to one embodiment of the invention. Specifically, FIG. 3 provides a detailed, cut-away view of bushing 300, showing the materials therein. The embodiment of FIG. 3 is somewhat similar to the embodiment of FIG. 2; however, bushing 300 utilizes single-piece grounding shield 301. The length of insulative portion 304 "L" can be adapted to a variety of applications, and can be around, e.g., ¼ inch to ⅝ inch for a bushing conforming to the IEEE STD 386 standard. The embodiment of FIG. 3 performs electrically in the same way that the embodiment of FIG. 2 performs, as described above.

Bushing 300 can be manufactured, e.g., by making J-ring 303, grounding shield 301, and internal shield housing (not shown) separately, then those pieces are put into an injection mold. In this example, grounding shield 301 includes a plurality of holes represented as arrows that let the insulative fill plastic flow therethrough. The fill insulation passes through the holes in grounding shield 301 to form insulative portion 304. The insulative fill rubber also forms non-conductive portion 302.

Figure 4:
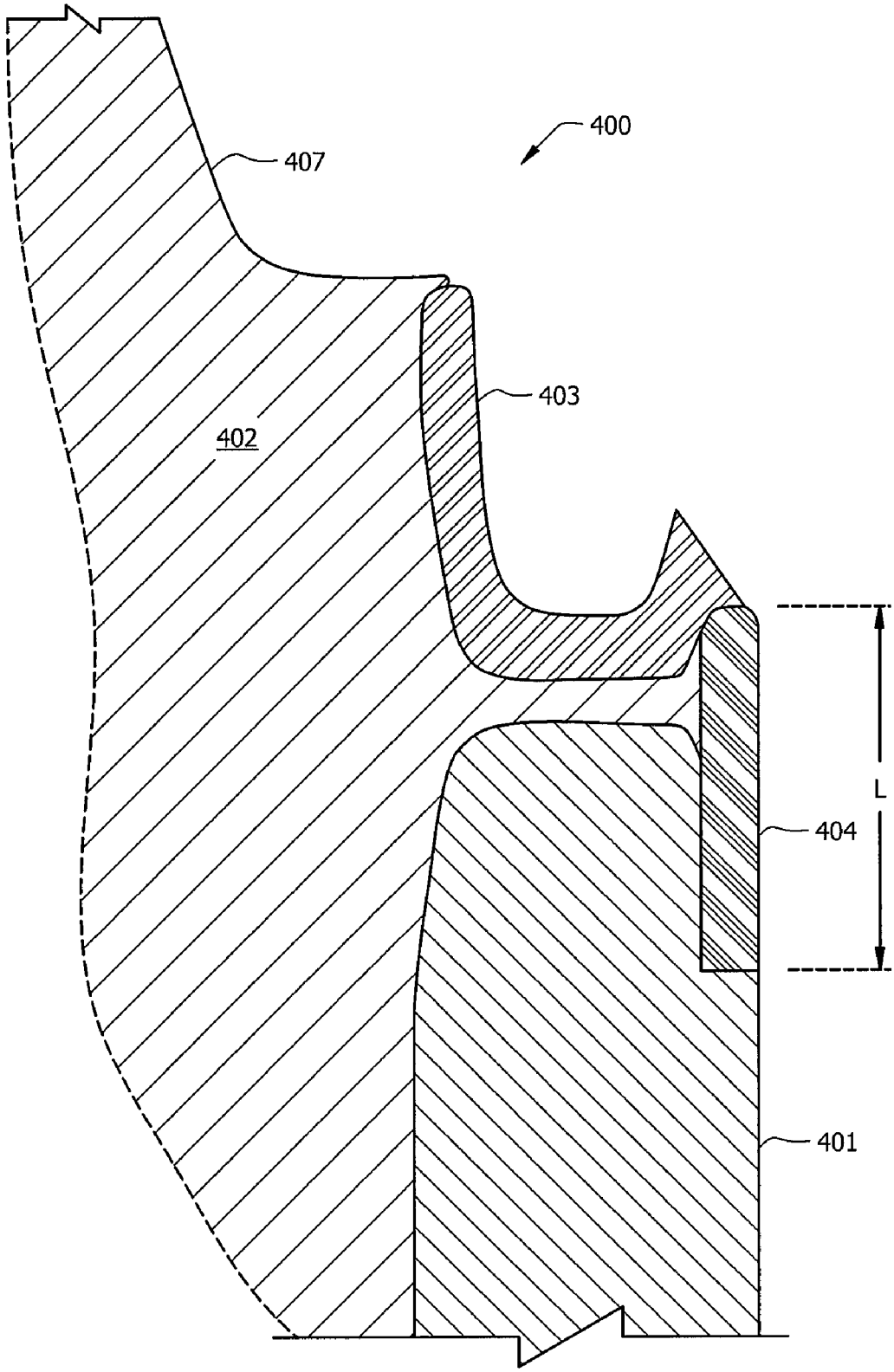
FIG. 4 is an illustration of an exemplary bushing adapted according to one embodiment of the invention.

FIG. 4 is an illustration of exemplary bushing 400 adapted according to one embodiment of the invention. Specifically, FIG. 4 is a detailed, cut-away view showing the materials inside bushing 400. Bushing 400 provides insulative portion 404, which is adjacent to J-ring 403 and covers a portion of grounding shield 401. Bushing 400 does not include grounding underneath J-ring 403 and proximate shoulder 407, but does provide ease of manufacture.

Bushing 400 includes separate cuff 404 that can be made of molded rubber, plastic, or other insulative material. In one example, cuff 404, J-ring 403, grounding shield 401, and the housing shield (not shown) are independently made and arranged in a fill mold. Then insulative rubber is injected into the mold, thereby creating non-conductive portion 402. In one example, during the injection molding process, the insulative rubber is hot and not vulcanized. As the insulative rubber, J-ring 403, rubber cuff 404, and grounding shield 401 are exposed to heat, the insulative rubber forms molecular bonds with the materials of J-ring 403, rubber cuff 404, and grounding shield 401. The bonding between the materials creates a seal that prevents arcing between the probe of the terminator and grounding during a partial vacuum condition. The length of insulative portion 404 "L" can be adapted to a variety of applications, and can be around, e.g., ¼ inch to ⅝ inch for a bushing conforming to the IEEE STD 386 standard.

Figure 5:
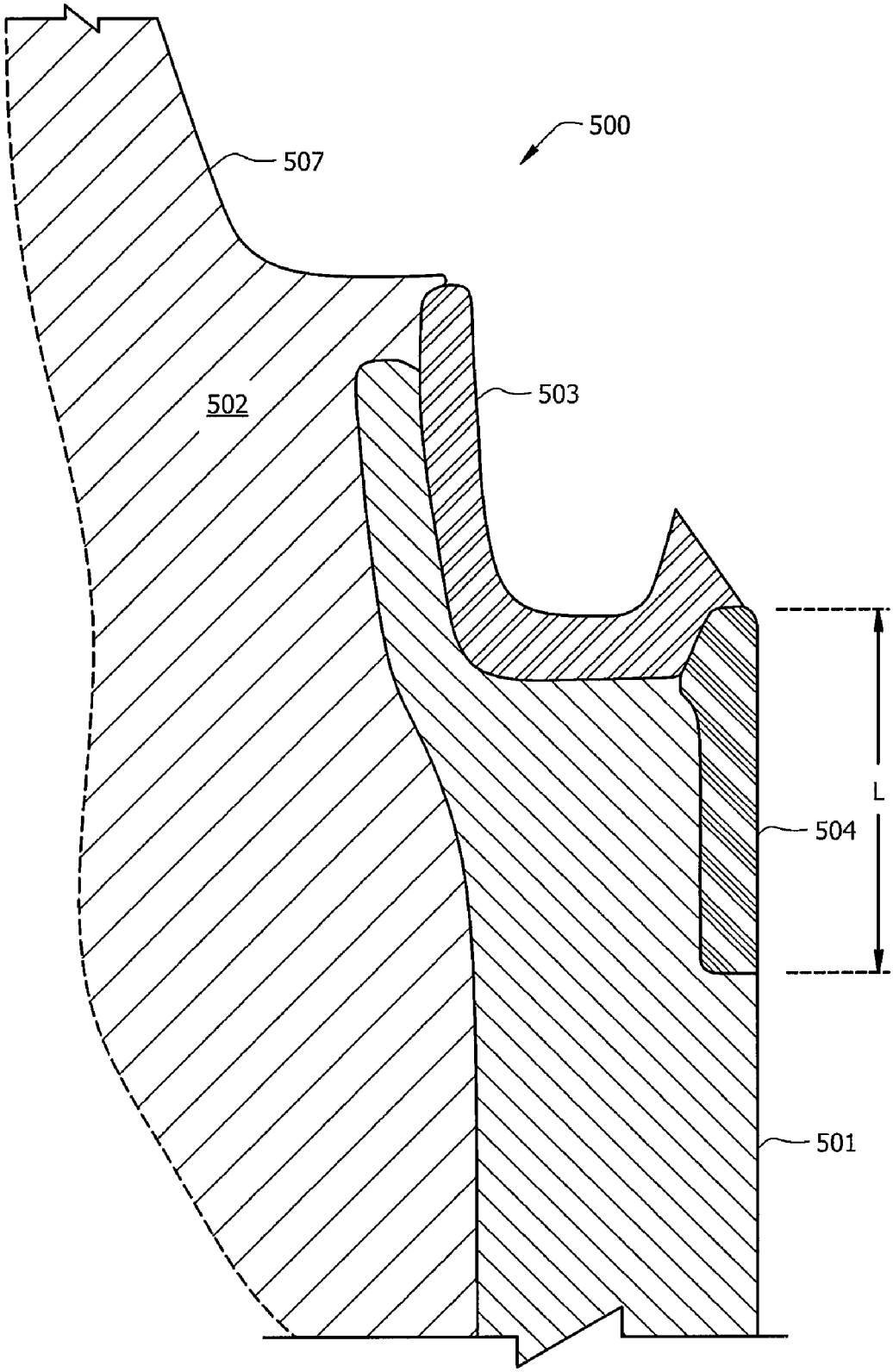
FIG. 5 is an illustration of an exemplary bushing adapted according to one embodiment of the invention.
Figure 6:
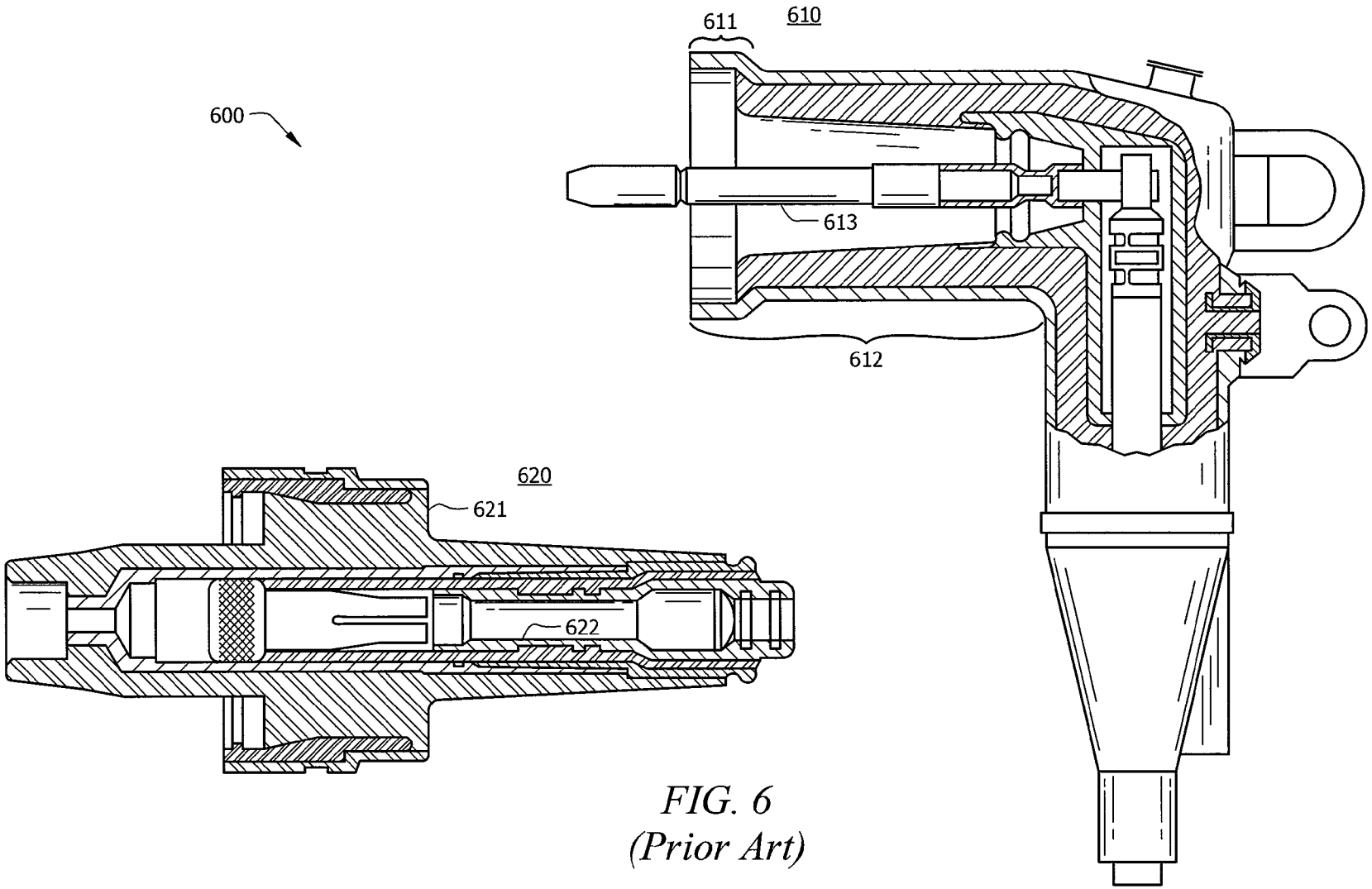
FIG. 6 (Prior Art)
FIG. 6 is an illustration of elbow/bushing assembly 600, which is one prior art embodiment.

FIG. 5 is an illustration of exemplary bushing 500 adapted according to one embodiment of the invention. Specifically, FIG. 5 shows a detailed, cut-away view of a portion of bushing 500 in order to illustrate the grounding properties of one embodiment. Bushing 500 includes grounding shield 501, J-ring 503, insulative portion 504, and non-conductive portion 502. Grounding shield 501 extends axially almost up to shoulder 507 and provides IEEE STD 386-specified grounding. In bushing 500, the material of insulative portion 504 bonds with the material of J-ring 503 to provide a seal that withstands partial vacuum and prevents arcing.

In one example, bushing 500 is made using the following process. The various components are made individually. For instance, J-ring 503 is molded. J-ring 503 is then placed into a mold, where screw-ram injection is used to mold the insulating plastic of insulative portion 504. During the molding process, J-ring 503 and insulative portion 504 are bonded together to make, in effect, one physical piece. Then, the portion that includes pieces 503 and 504 is placed in a fill mold along with grounding shield 501 and a housing shield (not shown). Then, insulative rubber is screw-ram injected to form non-conducting portion 502. The rubber of non-conducting portion 502 bonds to J-ring 503 and to grounding shield 501. The length of insulative portion 504 "L" can be adapted to a variety of applications, and can be around, e.g., ¼ inch to ⅝ inch for a bushing conforming to the IEEE STD 386 standard.

In an alternate embodiment, J-ring 503 and insulative portion 504 are made of one piece of plastic, e.g., yellow insulating plastic. After fill molding has been performed, the length "L" is painted black so that the yellow of J-ring 503 contrasts with the surrounding colors and performs its latch indication function.

Figure 7:
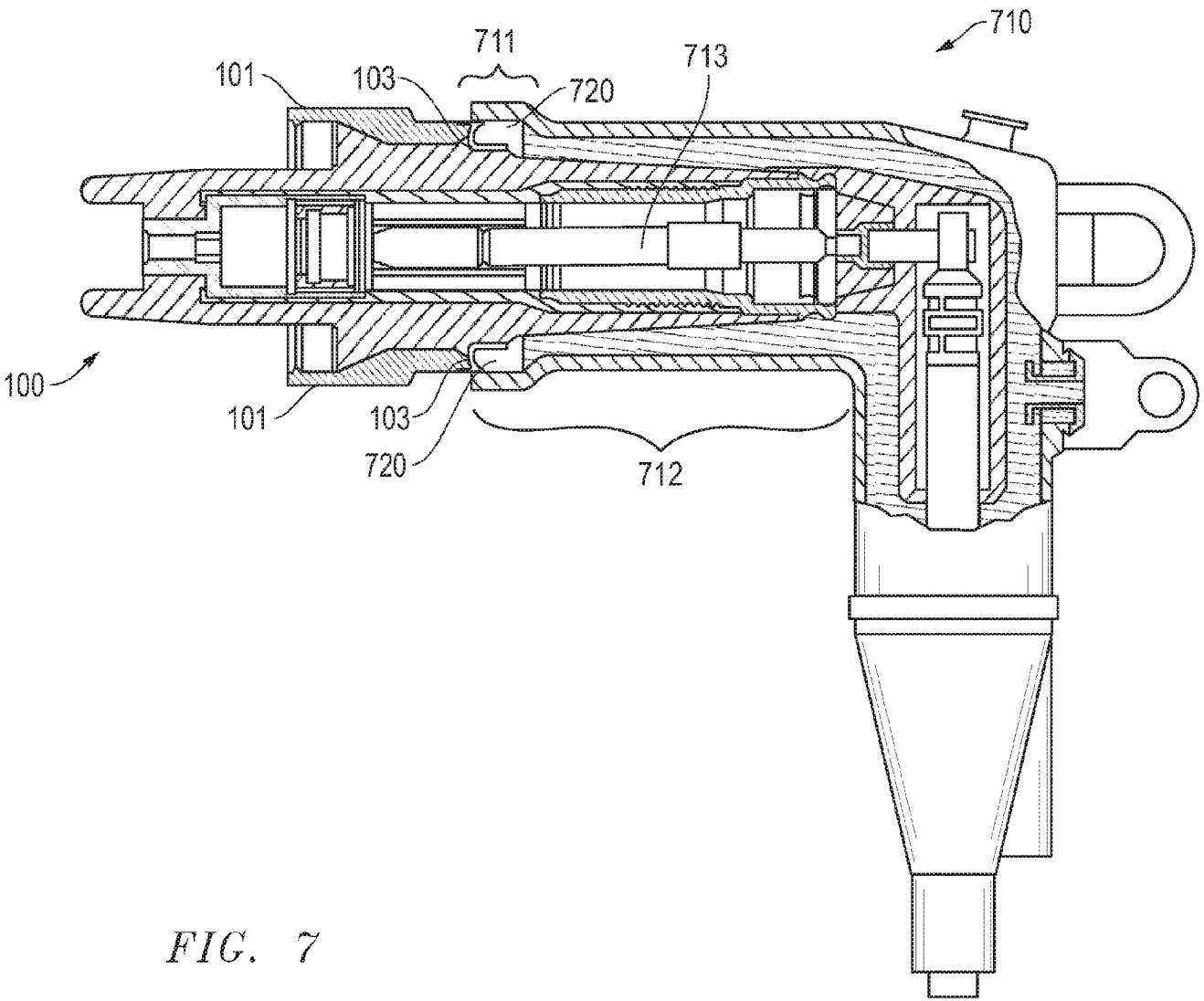
FIG. 7 is an illustration of elbow/bushing assembly in accordance with a particular embodiment.

FIG. 7 is an illustration of terminator/bushing assembly that includes elbow connector 710 and bushing insert 100. Bushing insert 100 has been previously described. Elbow connector 710 includes sleeve 712, cuff 711, and probe 713. When elbow connector 710 and bushing insert 100 are latched, elbow connector 710 interfaces with bushing insert 100 to make an electrical connection therewith. Sleeve 712 and cuff 711 of elbow connector 710 fit over an end of bushing insert 100 such that when bushing insert 100 and elbow connector 710 are completely coupled, cuff 711 fits snugly over J-ring 103. In a particular embodiment, J-ring 103 is disposed on an outside diameter of bushing insert 100 adjacent a shoulder of bushing insert and 100, J-ring 103 defines in part an air chamber 720 with cuff 711 when bushing insert 100 and elbow terminator 710 are completely coupled.

While the description herein has given examples of specific materials that may be used in various embodiments of the invention, it should be noted that other suitable materials can also be used. For instance, instead of EPDM rubber, some embodiments may use TPR or TPE, silicone rubber, epoxy, and/or the like. Moreover, dimensions given herein are for example only and should not be seen as limiting. Furthermore, while the embodiments herein have been described with respect to the IEEE STD 386 standard, embodiments of the invention can differ from the standard in many different respects. In fact, any high-voltage bushing that receives a probe from a terminator can be adapted according to the principles described herein.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A high-voltage electrical connector system comprising:

a bushing with a longitudinal axis, a shoulder, a first end, and a second end, wherein said shoulder is between said first end and said second end;

a ring arranged circumferentially around a first outside diameter of said bushing, said ring disposed between said shoulder and said second end, said ring including a channel therein defining a circumferential extension extending axially toward said first end;

a ground shield disposed on a second outside diameter of said bushing between said ring and said second end, said ground shield comprising one or more of conductive material and semi conductive material; and an insulative portion adjacent said ring and disposed circumferentially over a portion of said ground shield.

2. The high-voltage electrical connector system of claim 1 further comprising:

an elbow connector configured to interface with said bushing to make an electrical connection therewith, said elbow connector comprising a sleeve and a cuff to fit over said first end of said bushing such that when said bushing and said elbow are completely coupled, said cuff fits snugly over said ring.

3. The high-voltage electrical connector of claim 1 wherein said ring comprises a contrasting color and is disposed on said bushing to unambiguously indicate a fully coupled condition between said bushing and a terminator.

4. The high-voltage electrical connector of claim 1 wherein said ground shield comprises a semi conductive rubber collar that forms part of an outer surface of said bushing and extends circumferentially under a portion of said ring.

5. The high-voltage electrical connector of claim 1 wherein said ground shield comprises a single piece of semiconductive plastic, and wherein a portion of said ground shield extends axially toward said shoulder under a portion of said ring.

6. The high-voltage electrical connector of claim 1, wherein said ground shield does not contact said ring, and wherein a rubber fill of said bushing creates a sealing bond to said ring, said insulative portion, and said ground shield.

7. The high-voltage electrical connector of claim 1, wherein said insulative portion contacts said ring, and wherein said insulative portion makes a sealing bond with said ring.

8. The high-voltage electrical connector of claim 1 wherein at least a portion of said ground shield and a portion of said ring are each disposed circumferentially over an inner insulating layer.

9. The high-voltage electrical connector of claim 8 wherein said ground shield has one or more holes therein, and wherein material from said inner insulating layer protrudes through said one or more holes and defines said insulative portion.

10. The high-voltage electrical connector of claim 1 wherein said ground shield is disposed circumferentially under a portion of said ring.

11. The high-voltage electrical connector of claim 10 wherein a first portion of said ground shield that is circumferentially under at least a portion of said ring is separate from a second portion of said ground shield that forms an outer surface of said bushing.

12. The high-voltage electrical connector of claim 11 wherein said first portion comprises semiconductive plastic.

13. The high-voltage electrical connector of claim 11 wherein said second portion comprises semiconductive rubber.

14. The high-voltage electrical connector of claim 11 wherein said second portion comprises semiconductive ethylene propylene diene M-class (EPDM) rubber.

15. An electrical connector assembly comprising:

a bushing insert; and a terminator, said terminator having a sleeve and a cuff that fit over said bushing insert such that said bushing insert and said terminator form an air chamber between the sleeve and the bushing insert when said bushing insert and said terminator are completely coupled;

said bushing insert comprising:

a J-ring disposed on a first outside diameter of said bushing insert adjacent a shoulder of said bushing insert and configured to define in part said air chamber with said cuff when said bushing insert and said terminator are completely coupled;

a ground shield disposed on a second outside diameter of said bushing insert; and an insulative portion adjacent both said J-ring and said ground shield, said insulative portion disposed circumferentially over at least a portion of said ground shield.

16. The electrical connector assembly of claim 15, wherein said ground shield comprises a single piece of semi conductive plastic, and wherein a portion of said ground shield extends axially toward said shoulder under a portion of said J-ring.

17. The electrical connector assembly of claim 15, wherein said ground shield does not contact said J-ring, and wherein a rubber fill of said bushing creates a sealing bond to said J-ring, said insulative portion, and said ground shield.

18. The electrical connector assembly of claim 15, wherein said insulative portion contacts said J-ring, and wherein said insulative portion makes a sealing bond with said J-ring.

19. The electrical connector assembly of claim 15, wherein said ground shield is disposed circumferentially under a portion of said J-ring.

20. The electrical connector assembly of claim 19, wherein said ground shield comprises:

a first ground shield portion that is circumferentially under at least a portion of said J-ring; and a second ground shield portion that forms an outer surface of said bushing.

21. The electrical connector assembly of claim 20 wherein said first ground shield portion includes a plurality of holes therein allowing an insulative rubber to flow through said plurality of holes and form said insulative portion.

* * * * *